US006283034B1

(12) United States Patent
Miles, Jr.

(10) Patent No.: US 6,283,034 B1
(45) Date of Patent: Sep. 4, 2001

(54) REMOTELY ARMED AMMUNITION

(76) Inventor: D. Wayne Miles, Jr., 565 S. Main St., Sparta, NC (US) 28675

( * ) Notice: Subject to any disclaimer, the term of this patent is extended or adjusted under 35 U.S.C. 154(b) by 0 days.

(21) Appl. No.: 09/364,414

(22) Filed: Jul. 30, 1999

(51) Int. Cl.[7] ..... F42B 5/08

(52) U.S. Cl. ..... 102/430; 102/202.5; 102/472; 42/70.11

(58) Field of Search ..... 102/430, 470, 102/472, 202.5, 206; 42/70.11, 84; 89/6.5

(56) References Cited

U.S. PATENT DOCUMENTS

| | | | | |
|---|---|---|---|---|
| 3,736,837 | | 6/1973 | Kaprelian et al. | 89/28 R |
| 3,939,679 | | 2/1976 | Barker et al. | 70/277 |
| 4,003,152 | | 1/1977 | Barker et al. | 42/70 R |
| 4,145,970 | * | 3/1979 | Hedberg et al. | 102/206 |
| 4,237,789 | | 12/1980 | Stauers et al. | 102/270 |
| 4,324,060 | | 4/1982 | Lawrence | 42/84 |
| 4,488,370 | | 12/1984 | Lemelson | 42/70 R |
| 4,848,233 | | 7/1989 | Dow et al. | 102/202.2 |
| 5,044,278 | | 9/1991 | Campbell | 102/202.8 |
| 5,062,232 | | 11/1991 | Eppler | 42/70.11 |
| 5,461,812 | | 10/1995 | Bennett | 42/70.11 |
| 5,485,788 | * | 1/1996 | Corney | 102/472 |
| 5,603,180 | * | 2/1997 | Houze | 42/70.11 |
| 5,625,972 | | 5/1997 | King et al. | 42/84 |
| 5,636,464 | * | 6/1997 | Ciluffo | 42/70.11 |
| 5,896,691 | | 4/1999 | Kaminski et al. | 42/70.11 |

* cited by examiner

*Primary Examiner*—Harold J. Tudor
(74) *Attorney, Agent, or Firm*—McGuireWoods LLP

(57) ABSTRACT

A firearms safety device in the form of remotely armed ammunition includes a firearms cartridge for use in a use with a conventional firearm having a trigger-actuated hammer with a firing pin. The cartridge includes a firing circuit that is operatively associated with a primer for igniting a conventional propellant charge. A firing sequence is initiated by the impact of the firing pin with the base of the cartridge. An arming circuit allows the firing sequence to proceed to ignition of the propellant only if a receiver within the arming circuit receives an appropriate arming signal transmitted by a remote control module. In the absence of an appropriate arming signal, the cartridge is permanently disabled.

13 Claims, 4 Drawing Sheets

REMOTELY ARMED AMMUNITION

BACKGROUND OF THE INVENTION

The present invention relates broadly to ammunition and, more particularly, to ammunition that can only be fired in the presence of a remotely transmitted arming signal.

A problem that is increasing in scope is the use of firearms by unauthorized persons, particularly minors. Another problem with similar effects is accidental discharge of firearms. Due to the increased population and the proliferation of firearms, there is an elevated need for effective firearm safety and control.

Traditionally, firearms control has been accomplished through physical control of the weapon or its ammunition. Physical control is typically accomplished by placement of the weapon or ammunition in lockable storage. This has the obvious disadvantage of inaccessibility and consequent delay when the firearm is needed for protection. Another method involves the placement of a mechanical lock on the trigger mechanism of the firearm. While preventing children or other unauthorized users from recklessly or maliciously discharging a weapon, these methods and associated apparatus can hinder, sometimes dangerously, the lawful owner's access to a weapon.

Another type of problem exists relative to the unauthorized use of a firearm. Tragically, some law enforcement officers are shot with their own weapons, or the weapons of fellow officers that have been forcefully and unlawfully obtained by a criminal suspect. While law enforcement officers exercise physical control over an otherwise "unlocked" or usable weapon, those who would seek to do harm to the officer to prevent their own arrest or apprehension sometimes gain control over the officer and obtain the weapon. This problem cannot be solved by mechanical restraints. Trigger locks and gun cabinets cannot be used in a mobile law enforcement setting.

A recent alternative to traditional control methods involves the development of firearms that include control circuitry intended to prevent firing by unauthorized persons. This technology could provide a benefit for the law enforcement community, however, these firearms have heretofore been relatively complex, costly and unreliable. More importantly, retrofitting existing firearms to use this method of control is impractical or may be impossible for some weapons. The need for firearm replacement makes use of these weapons very expensive. Further, if the safety system fails, the entire weapon may be rendered useless. This can create a dangerous situation.

Accordingly, there exists a need for a firearm safety device for preventing the unauthorized use and discharge of a firearm wherein the safety device is independent of the firearm. In particular, there is a need for such a device that would be usable in existing firearms without retrofit or modification of the existing firearm. The device must be highly reliable and should be relatively low in cost.

SUMMARY OF THE INVENTION

It is accordingly an object of the present invention to provide ammunition that can be used to aid in the prevention of unauthorized firearm usage including unauthorized or accidental discharge.

It is also an object of the present invention to provide ammunition that includes an electrically initiated firearms cartridge armable by a remote arming transmitter.

It is a further object of the present invention to provide a remotely armed cartridge that is usable in existing hammer-initiated firearms without the need for retrofitting or otherwise modifying the firearm.

Another object of the present invention is to provide a remotely armed cartridge that will fire only when initiated within a predetermined range from the arming transmitter.

Yet another object of the present invention is to provide a remotely armed cartridge that will be permanently disabled if initiated outside a predetermined range from the arming transmitter.

It is still another object of the present invention to provide ammunition that includes a loaded cartridge case to which a projectile can be added to form a remotely armed firearms cartridge.

To those ends, remotely armed ammunition according to the present invention includes a cartridge for use with a conventional firearm having a trigger-actuated hammer having a firing pin for initiating a firing sequence. The cartridge has a case defining a chamber for disposition of a propellant charge therein. The cartridge also has a primer pocket for disposition of a primer therein and an open end having a projectile seated thereon. The ammunition includes a primer disposed in the primer pocket for igniting the propellant charge to produce controlled projectile discharge. The ammunition further includes a firing circuit operatively associated with the primer for controlled ignition thereof. The firing circuit is activated to initiate the firing sequence by operation of the firing pin. The firing circuit includes an arming circuit for selectively enabling or disabling firing operation of the cartridge by allowing or preventing completion of the firing sequence. The ammunition also includes an arrangement for remotely controlling operation of the arming circuit.

The primer of the remotely armed ammunition according to the present invention is preferably electrically initiated.

The arrangement for remotely controlling operation of the arming circuit of remotely armed ammunition according to the present invention preferably includes a transmitter for transmitting an arming signal. The arming circuit preferably includes a receiver for receiving the arming signal when the cartridge is within a predetermined range of the transmitter. The arming circuit allows the firing sequence to be completed responsive to the presence of the arming signal, thereby allowing the cartridge to fire.

The arming circuit of remotely armed ammunition according to the present invention preferably includes a fail-safe circuit for disabling the cartridge to prevent the firing thereof. The fail-safe circuit prevents completion of the firing sequence after initiation thereof responsive to the absence of the arming signal. The firing circuit further preferably includes an energy source such as a battery, to provide operational power for the firing circuit and for igniting the primer when the firing sequence is completed.

Remotely armed ammunition according to the present invention preferably further includes a barrier member disposed adjacent the battery. The barrier member is preferably configured so that impact of the firing pin with the barrier member causes the firing circuit to be activated, thereby initiating the firing sequence.

The transmitter of the remotely armed ammunition according to the present invention is preferably configured to transmit the arming signal in the form of electromagnetic signals that are transmitted and received at a predetermined frequency. Typically, such a transmitter is a radio frequency transmitter. Alternatively, the transmitter may be configured to transmit the arming signal in the form of ultrasonic signals. The arrangement for remotely controlling operation of the arming circuit preferably includes an arrangement for encoding the arming signal prior to transmission by the transmitter. The firing circuit preferably includes an arrangement for decoding the arming signal after receipt thereof by the receiver.

According to one preferred embodiment of the present invention, remotely armed ammunition for use with a conventional firearm having a trigger-actuated hammer with a firing pin for initiating a firing sequence includes a cartridge case defining a chamber for disposition of a propellant charge therein. The ammunition also has a primer pocket for disposition of a primer therein and an open end configured for seated receipt of a projectile thereon. The ammunition includes a primer disposed in the primer pocket for igniting the propellant charge to produce controlled projectile discharge. The ammunition further includes a firing circuit operatively associated with the primer for controlled ignition thereof. The firing circuit is activated to initiate the firing sequence by operation of the firing pin. Included in the firing circuit is an arming circuit for selectively enabling or disabling firing operation of the ammunition by allowing or preventing completion of the firing sequence. The ammunition further includes an arrangement for remotely controlling operation of the arming circuit.

In another preferred embodiment of the present invention, electrically initiated ammunition for use with a conventional firearm having a trigger-actuated hammer with a firing, pin for initiating a firing sequence includes a cartridge having a case defining a chamber for disposition of a propellant charge therein. The cartridge also has a primer pocket for disposition of a primer therein and an open end having a projectile seated thereon. The ammunition includes an electrically ignited primer disposed in the primer pocket for igniting the propellant charge to produce controlled projectile discharge. The ammunition further includes a firing circuit operatively associated with the primer for controlled ignition thereof. The firing circuit is activated to initiate the firing sequence by operation of the firing pin. The firing circuit includes an arming circuit for selectively enabling or disabling firing operation of the cartridge by allowing or preventing completion of the firing sequence. The firing circuit further includes a battery to provide operational power for the firing circuit and for igniting the primer when the firing sequence is completed. A barrier member is disposed adjacent the battery and is configured so that impact of the firing pin with the barrier member causes the firing circuit to be activated, thereby initiating the firing sequence. Also included in the ammunition is a transmitter for remotely controlling operation of the arming circuit by transmitting an arming signal within a predetermined range, thereby providing an arrangement for remotely controlling operation of the arming circuit. A receiver operatively associated with the arming circuit is also included for receiving the arming signal when the cartridge is within the predetermined range. The arming circuit allows the firing sequence to be completed responsive to the presence of the arming signal, thereby allowing the cartridge to fire.

In another preferred embodiment of the present invention, remotely armed ammunition for use with a conventional firearm having a trigger-actuated hammer having a firing pin for initiating a firing sequence is provided and includes a primer load. The primer load is configured for disposition in a case that defines a chamber for disposition of a propellant charge therein. The case further defines a primer pocket for disposition of a primer therein and has an open end having a projectile seated thereon. The ammunition according to this embodiment includes a generally cylindrical casing defining a firing circuit chamber. This casing is configured for disposition within the primer pocket. Also included is an electrically ignited primer disposed within the firing circuit chamber for igniting the propellant charge for controlled projectile discharge.

A firing circuit is operatively associated with the primer for controlled ignition thereof. The firing circuit is activated to initiate the firing sequence by operation of the firing pin and includes an arming circuit for selectively enabling or disabling firing operation of the cartridge by allowing or preventing completion of the firing sequence. The firing circuit also includes a battery to provide operational power for the firing circuit and for igniting the primer when the firing sequence is completed. A barrier member is disposed adjacent the battery and is configured so that impact of the firing pin with the barrier member causes the firing circuit to be activated, thereby initiating the firing sequence.

The ammunition according to this embodiment further includes a transmitter for remotely controlling operation of the arming circuit by transmitting an arming signal within a predetermined range. The primer load includes a receiver operatively associated with the arming circuit for receiving the arming signal when the cartridge is within the predetermined range. The arming circuit allows the firing sequence to be completed responsive to the presence of the arming signal, thereby allowing said cartridge to fire.

By the above, the present invention provides an effective apparatus for preventing accidental or unauthorized discharge of a firearm. The remotely armed cartridge of the present invention may only be fired when within a predetermined proximity of the arming transmitter associated therewith. Thus, the use of a loaded firearm can be controlled by maintaining control of the transmitter.

DESCRIPTION OF THE PREFERRED EMBODIMENT

Figure 1:
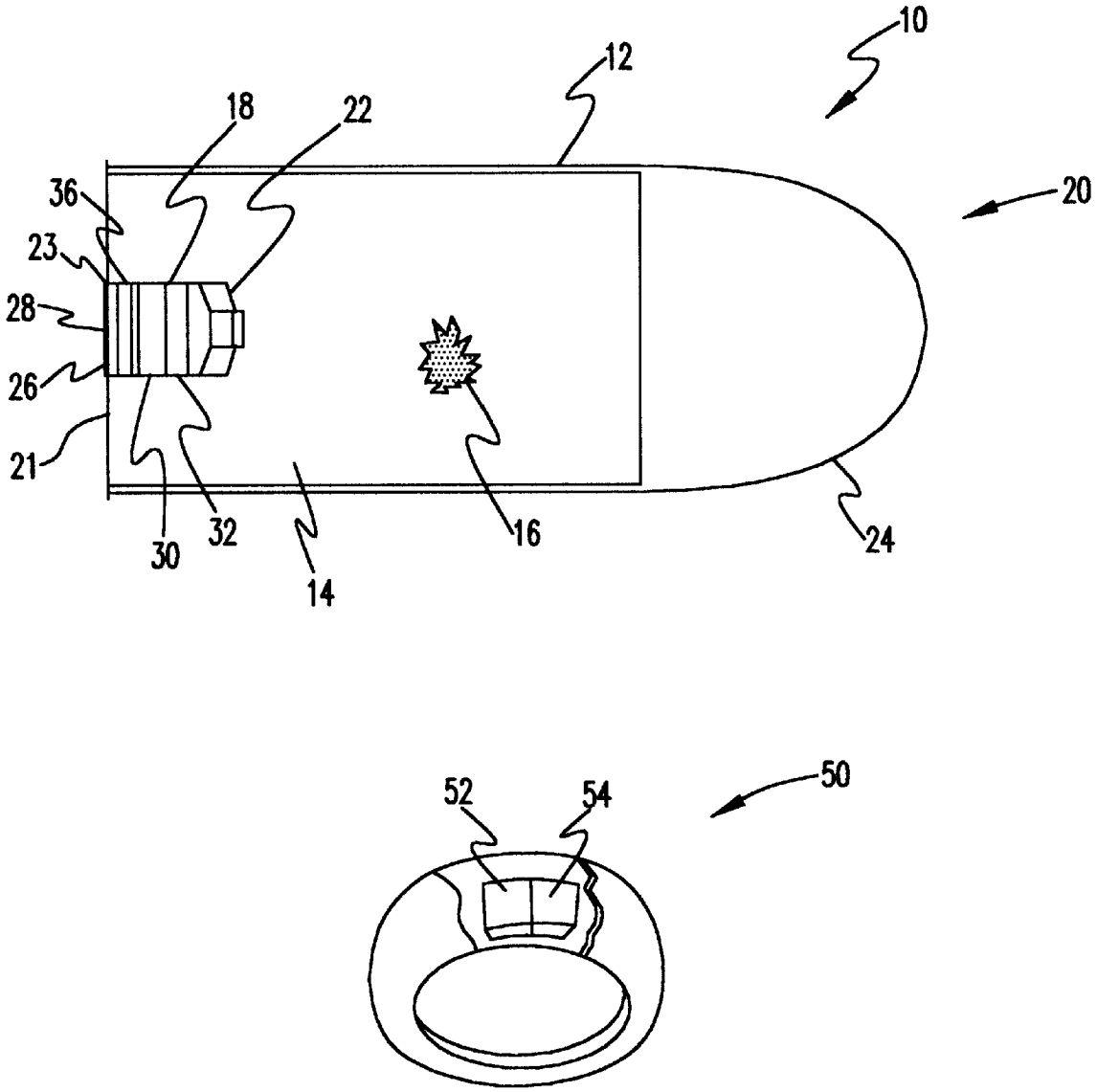
FIG. 1 is a side cutaway diagrammatic view of remotely armed ammunition according to a preferred embodiment of the present invention.

Turning now to the drawings and more particularly to FIG. 1, remotely armed ammunition is illustrated generally at 10 and includes a cartridge 20 and a remote control module 50 illustrated herein in the form of a ring that can be worn by an authorized user to control operation of the firearm. It will be understood that the remote control module 50 can take many forms, and should not be limited to a miniature transmitter encased in jewelry.

The ammunition of the present invention is intended to prevent a loaded firearm from being discharged inadvertently or by an unauthorized user. This is accomplished by loading the firearm with a cartridge 20 that will not fire unless it is within a predetermined range of the operational control module 50. With the remotely armed ammunition of the present invention, as long as the firearm is outside of the predetermined range, or if the control module 50 is non-operational, an attempt to use the firearm-by operating the firearm's trigger-actuated hammer will permanently disable the cartridge 20. On the other hand, authorized users carrying the activated control module 50 may use the firearm to fire the cartridges 20 in a conventional manner.

Figure 3:
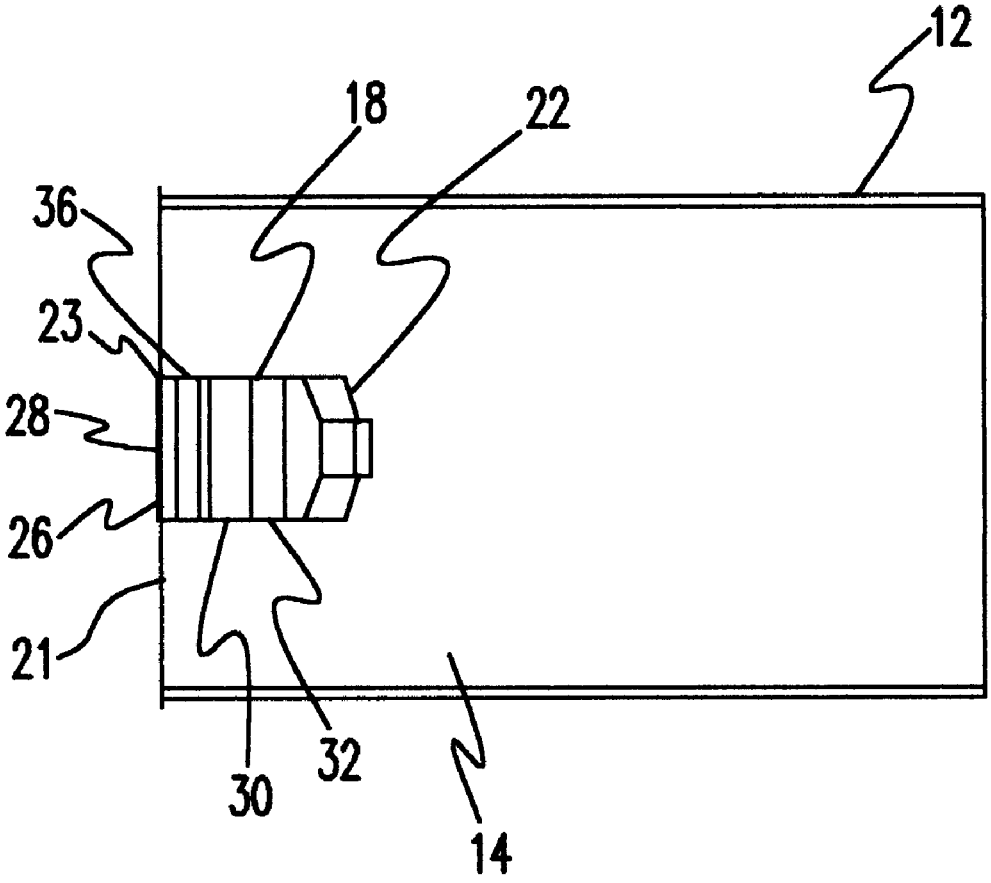
FIG. 3 is a side cutaway diagrammatic view of an ammunition case without propellant or projectile according to another preferred embodiment of the present invention.
Figure 4:
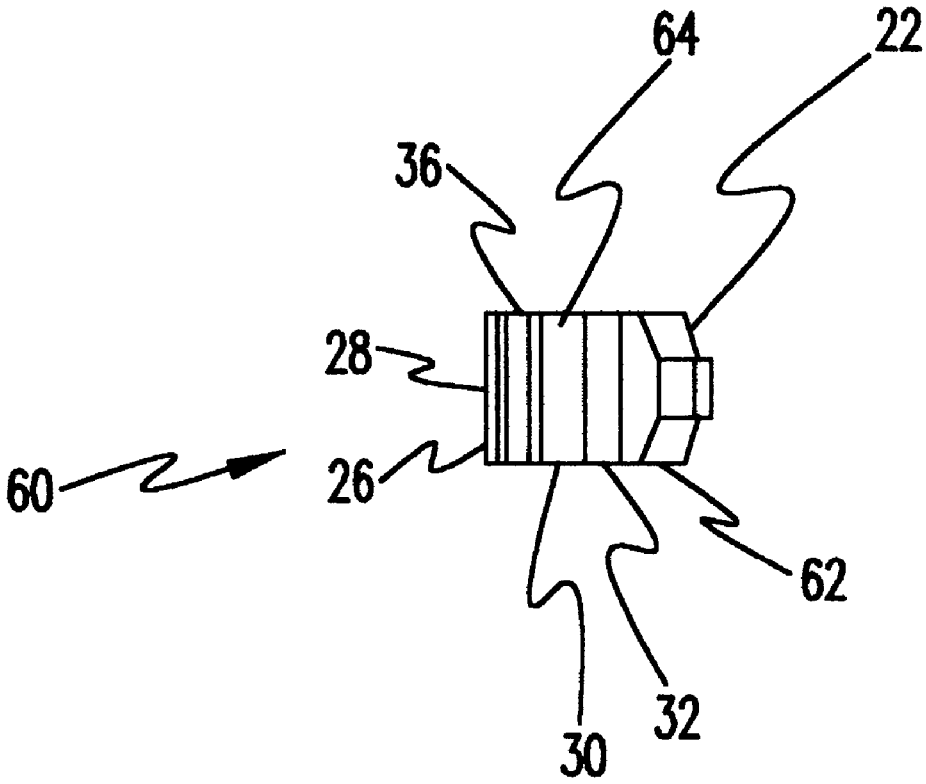
FIG. 4 is a side cutaway diagrammatic view of a primer load according to another preferred embodiment of the present invention.

As shown in FIG. 1, the cartridge 20 has a conventional cylindrical case 12 defining a chamber 14 loaded with propellant, illustrated partially at 16. It will be understood by those skilled in this art that a sufficient amount of propellant 16 based on bullet weight and other factors must be used. At one end, the case 12 has an annular base 21 defining an initiation port 23. The end of the case 12 opposing the base 21 is open and configured for seated receipt of a conventional bullet projectile 24. It will be appreciated by those with ordinary skill in the art that the present invention may be supplied as a complete cartridge 20 including a projectile 24 or as a case 12 without propellant 16 or projectile 24 for the reloading market as seen in FIG. 3. The present invention may also be supplied as a primer load 60, as shown in FIG. 4, that can be used with a separately obtained case 12, propellant 16 and projectile 24. The non-loaded case and primer load embodiments are intended primarily for the reloading market and are discussed in more detail hereafter.

A generally cylindrical primer pocket 18 is disposed within the chamber 14 with one end of the primer pocket 18 formed by a barrier member 26 disposed across the initiation port 23. The barrier member 26 is formed from a material that is either deformable or penetrable by the firing pin of a conventional hammer-actuated firearm (not shown) as will be described in more detail hereafter. A protective film 28 formed from a material such as teflon or plastic may be disposed over the barrier member 26 to provide protection against moisture and corrosion.

The ammunition 10 includes an electrically initiated primer 22 positioned in the primer pocket 18 of the cartridge 20. When electrical power is applied, the primer 22 ignites and its combustion products, in turn, ignite the propellant charge 16. The expansion of the combustion products of the propellant charge 16 then propels the projectile 24 from the firearm (not shown). In other electrically initiated systems, the primer is typically initiated using a power source exterior to the cartridge. In the ammunition 10 of the present invention, the primer 22 is operatively associated with a firing circuit 30 that includes an energy source, such as a battery 36, housed within the cartridge 20 itself. The battery 36 is disposed within the primer pocket 18 adjacent but spaced apart from the barrier member 26. It will be understood by those skilled in the art that, given the short duration and relatively low power requirements, another energy source such as a capacitor may be used instead of the battery 36.

Figure 2:
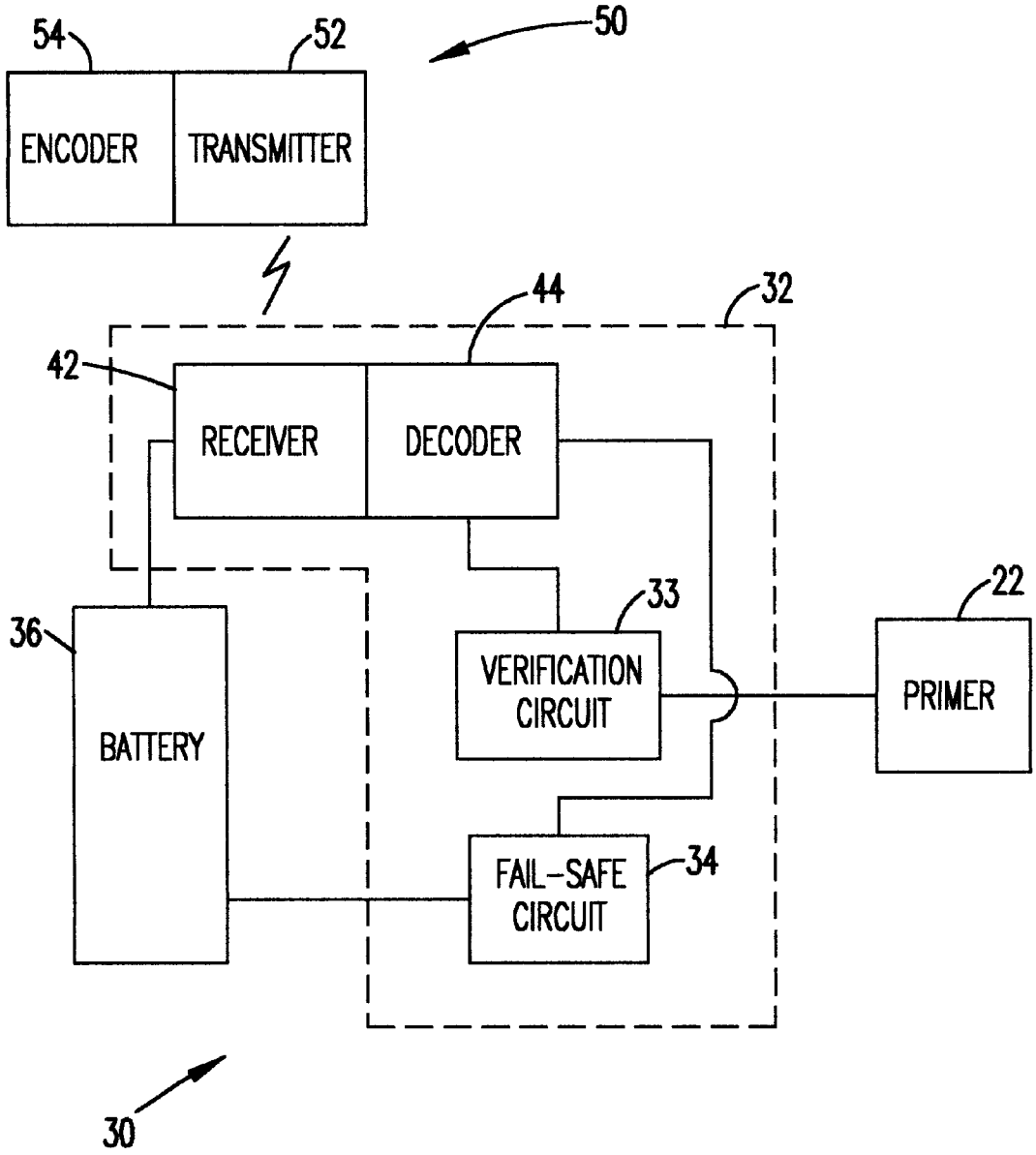
FIG. 2 is a schematic representation of the remotely armed ammunition illustrated in Figure 1.

As seen in FIG. 2, the firing circuit 30 includes the aforesaid battery 36 in electrical communication with an arming circuit 32 and the primer 22. The arming circuit 32 includes a receiver 42, a decoder 44, a verification circuit 33 and a fail-safe circuit 34. The arming circuit 32 is configured to ignite the primer responsive to energy application from the battery 36. It should be understood by those skilled in the art that the firing circuit 30 may be miniaturized and may take any electronic form sufficient to carry out the prescribed functions.

Activation of the firing circuit 30 initiates a firing sequence that, if completed, results in the application of electrical power to the primer 22 and ignition of the propellant 16. The firing circuit 30 is activated by the impact of the firing pin of the trigger-actuated hammer of the firearm (not shown) with the barrier member 26. The barrier member 26 is formed from a deformable, electrically conductive material and is in electrical communication with the firing circuit 30. The barrier member 26 is configured so that impact of the firing pin with the barrier member 26 causes the barrier member 26 to deform and make contact with the battery 36. The firing circuit 30 is configured so that this contact closes and activates the firing circuit 30 and initiates the firing sequence. It should be noted that alternate positions of the battery 36 are possible wherein the barrier member 26 does not contact the battery 36 directly to activate the firing circuit 30.

In another embodiment, the battery 36 is movable between a non-operational first position and a second position where it is placed in operational electrical communication with the remainder of the firing circuit 30. Initially, the battery 36 is disposed in the first position and the firing circuit 30 is not powered. Deformation of the barrier member 26 by the firing pin causes the barrier member 26 to contact the battery 36 and forces it to move from the first position to the second position, thereby activating the firing circuit 30 and initiating the firing sequence. In this embodiment, the barrier member 26 need not be formed of a conductive material because it does not itself form part of the circuit.

In an embodiment usable in firearms having an electrically conductive path between a conductive firing chamber and a conductive hammer and firing pin, the barrier member 26 is formed of a penetrable nonconductive material. In this embodiment, the primer 22 is in electrical communication with the metal chamber of the firearm, preferably through the case 12. When the hammer is triggered, the firing pin strikes and penetrates the protective film 28 and the barrier member 26, then contacts the battery 36. This closes and activates the firing circuit 30 and initiates the firing sequence.

The arming circuit 32 is configured to selectively permit or prevent the completion of the firing sequence; i.e., the arming circuit 32 either enables the firing circuit 30 to apply power from the battery 36 to the primer 22 for initiation thereof or disables the firing circuit 30 thereby preventing the cartridge from discharging.

The arming circuit 32 includes a receiver 42 that is configured for receiving an arming signal from a control module 50 external to the firearm, as will be explained in greater detail hereinafter. The receiver 42 receives the arming signal in the form of electromagnetic signals of a predetermined frequency. Suitable receiving devices small enough for use in the ammunition 10 are available from many suppliers. Alternatively, the receiver 42 may be configured for receiving remotely generated ultrasonic signals. The arming circuit 32 also includes a decoder 44 for decoding an arming signal that has been encoded in a manner described in greater detail hereafter.

The control module 50 provides an arrangement for remotely controlling the operation of the arming circuit 32, and is configured to be worn by an authorized user. FIG. 1 illustrates the control module 50 in the form of a ring. Nevertheless, it will be apparent that the control module 50 can take many forms and still provide the necessary housing for the control circuitry. The control module 50 includes a transmitter 52 that is configured to selectively transmit an arming signal to the receiver 42. The transmitter 52 contains an energy source and is configured to transmit electromagnetic signals at a predetermined frequency receivable by the receiver 42. Small transmitters of this type that are suitable for use in the present invention are known generally in the art and are typically available. The transmitter 52 may also be configured to transmit ultrasonic signals receivable by an ultrasonic version of the receiver 42. With either type of transmission set, it will be understood by those of ordinary skill in the art that the design variables of the transmitter 52 and receiver 42 may be jointly selected so that signals transmitted by the transmitter 52 will be received by receiver 42 only when receiver 42 is within a predetermined range of the transmitter 52. The transmitter 52 may be configured so that the transmission power is variable by the user, thus permitting variation in the range at which the receiver 42 will receive transmissions.

The frequency at which a particular transmitter 52 and receiver 42 pair operate should be as nearly unique as possible. This may be accomplished through the manufacture of ammunition 10 using a large number of varying frequencies so that the probability of a non-paired transmitter 52 and receiver 42 having the same frequency would be small. This would reduce the likelihood of inadvertent arming of ammunition for one firearm by a control module intended for use with another firearm or by a different person.

The likelihood of inadvertent arming may be further reduced by including a unique code in the arming signal. Accordingly, the control module 50 preferably includes an encoder 54 for encoding the arming signal prior to transmission. The encoder 54 is preferably configured to use a substantially unique digitized code for transmission by the transmitter 52 to the receiver 42. This code may be preprogrammed into the control module 50 or may be optionally entered by the user when the control module 50 is to be activated. The arming circuit 32 includes a code verification circuit 33 that assesses the arming signal code and determines if the firing sequence should be allowed to proceed. The arming circuit 32 is configured so that the firing circuit 30 will be enabled only if the correct code is received. Additional safety may be provided through the use of ordinary encryption and decryption techniques by the encoder 54 and the decoder 44. It will be apparent to those skilled in the art that other techniques for providing a unique or semi-unique arming signal to the transmitter may also be used.

It is contemplated that the frequency or unique code may be programmable by a user. This would allow for example, an entire police department to share a unique code so that any officer could fire any other officer's weapon to the exclusion of those not authorized by the respective police department.

Three separate events could prevent the completion of the firing sequence. First, the signal could be received with the wrong code. Second, the firing sequence could be commenced without an arming signal within range. Third, the arming signal may be present, but at the wrong frequency.

As noted above, the arming circuit 32 will enable the firing circuit 30 only if the receiver 42 receives the correct arming signal code upon activation of the firing circuit 30 as determined by the verification circuit 33. If the receiver does not receive the arming signal upon activation, i.e., the signal is at an incorrect frequency or merely not present at all, the primer 22 does not fire. In addition, the present invention includes a fail-safe circuit 34 within the arming circuit 32 that permanently disables the firing circuit 20 if the firing circuit 20 is activated and the correct arming signal code is not received. This assures that a delayed initiation of the primer 22 cannot occur as a result of the receipt of a belated arming signal.

As discussed above, the control module 50 may be housed in virtually any form but is particularly useful when packaged so that it may be attached to a belt or kept in a pocket of the user's clothing. Alternatively, the control module may be incorporated into a bracelet, band or ring that may be worn at all times when the user may have a need to use the-ammunition 10. The control module 50 is preferably configured for selective activation by the user on a per-use basis but could also be configured for long term continual transmission. The latter may be preferable for users such as police officers who are more likely to have an immediate emergency need to use their firearms.

As noted above, the present invention may also be supplied in forms directed toward the reloading market. The term"reloading" as used herein refers to the process of assembling live ammunition such as cartridges from their component parts. This process, sometimes referred to as handloading, is typically non-commercial and is often the province of hobbyists. Because it permits the individual ammunition user to make his own design trade-offs as to the propellant charge, projectile size and configuration, etc., reloading allows the tailoring of ammunition to a particular firearm or to the needs of the reloader. The result is that reloaded or handloaded ammunition can provide greater accuracy than does typical factory ammunition.

The present invention includes two embodiments that may be used to form remotely armed cartridges using the reloading process. The first, shown in FIG. 3 without its associated control module, is essentially the same as the above-described embodiment having a complete cartridge except that it is provided without propellant 16 or a projectile 24. This embodiment thus includes a case 12, a primer 22 and a firing circuit 30 identical to those previously described. A measure of propellant and a projectile of the reloader's choosing may be added using conventional handloading techniques.

The second reloading embodiment, shown in FIG. 4, is a primer load, illustrated generally at 60. The primer load 60 includes a generally cylindrical casing 62 defining a firing circuit chamber 64 that is open at one end and capped at the other end by a barrier member 26. A primer 22 and a firing circuit 30 are disposed within the firing circuit chamber 64. The firing circuit 30 is identical to that described above and includes an arming circuit 32 and a battery 36. The primer load 60 is configured for assembly with a case 12, propellant 16 and a projectile 24 to form a complete remotely armed cartridge. Because of its modular form, this embodiment of the present invention is highly flexible and is ideal for the reloader market.

To use the remotely armed ammunition 10, the user loads at least one cartridge 20 into a firearm having a trigger-actuated hammer with a firing pin. The control module 50, which is pre-programmed with an arming code corresponding to the code required by the arming circuit 32, is activated by the user and placed so that the firearm and cartridge 10 are within the predetermined range of the receiver. For most purposes, the predetermined range is likely to be no more than a few feet and could be as little as six to twelve inches. The shorter range would be preferred, for example, if the control module was built into a wrist band or finger ring and would reduce the power requirements of the transmitter 52. When the control module 50 is activated, the encoder 54 provides the code to the transmitter 52 which begins transmitting the coded arming signal using the frequency associated with the receiver 42. The user then pulls the trigger, thereby releasing the hammer of the firearm in a conventional manner to fire the cartridge 10. The firing pin of the hammer strikes the barrier member 26 thereby activating the firing circuit 20 and initiating the firing sequence. Upon activation of the firing circuit 20, the receiver 42 receives the encoded arming signal from the transmitter 52 and passes it to the decoder 44 for decoding. Responsive to the receipt of the correct arming signal, the arming circuit 32 allows the firing sequence to proceed. Power from the power source 36 is then directed through the firing circuit 20 to the primer 22, thereby igniting the primer, and in turn, igniting the propellant 16 to expel the projectile 24 from the firearm barrel at the nominal muzzle velocity.

If the control module 50 is not activated or if the receiver 42 is not within the predetermined range of the transmitter 52, as would be the case if an unauthorized person attempted to discharge the firearm, the firing pin would activate the firing circuit 20 in the same manner as described above. Upon activation of the firing circuit 20, the receiver 42 would fail to receive the arming signal. Responsive to the absence of a correct arming signal, the arming circuit 32 would terminate the firing sequence by disabling the firing circuit 20. The cartridge 10 would thus be prevented from firing. A similar result would be obtained if the receiver 42 was in range of a transmitter 52 but received an incorrect arming code as determined by the arming circuit 32, or failed to detect an arming signal transmitted at the wrong frequency.

The ammunition 10 of the present invention provides enhanced control and an additional safety measure for firearm users. When loaded with the ammunition 10, a firearm is usable only by a person having access to the proper control module 50. Thus, control maybe maintained over the firearm through possession of the control module 50. Ideally, the control module 50 is maintained on the person of the firearm owner in a non-obtrusive manner so that it is always readily available and, moreover, is always within the control of that person. By incorporating the control module 50 into a watchband for example, the control module 50 is readily available at need, is always in the control of the authorized user and is unobtrusive.

In many firearms, the efficacy of the ammunition 10 as a safety device requires that only the ammunition 10 be used. In order to assure the safety of a revolver, for example, all the cartridges loaded in the cylinder must be controlled because any of them may be positioned for firing at any given time. In firearms that use a specific sequence of cartridges, however, a measure of safety can be achieved without using a full load of remotely armed ammunition 10. Clip-loaded weapons, for example, must fire cartridges in the order in which they are loaded in the clip. Such firearms may be made safe against a single accidental discharge by using a remotely armed cartridge 20 as the first or next-to-fire cartridge in the clip. The remaining cartridges may be conventional. Because the remotely armed cartridge 20 must be fired first, the ordinary cartridges can only be fired after the cartridge 20 is chambered and ejected. The added actions make inadvertent firing unlikely. Further, the present invention has no adverse effects on muzzle velocity or other aspects of firearm performance.

By the above, the present invention provides a versatile firearm safety device with a wide application. By preventing accidental and unauthorized firearm use, the remotely armed ammunition of the present invention can provide added safety for homeowners, shopkeepers, and law enforcement and military personnel.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. Remotely-armed ammunition for use with a conventional firearm having a trigger-actuated firing pin, the ammunition comprising;

a cartridge having a case having, at one end, a pocket into which a primer load is inserted, propellent within the case, and, at an end opposite the pocket, an open end into which a projectile is inserted;

a primer load including circuitry which selectively permits igniting a primer, the primer load being inserted into the pocket of the cartridge; and means for remotely controlling operation of the primer load which includes a receiver for receiving an arming signal when the receiver is within a predetermined range of a transmitter which is separate from the cartridge and the firearms.

2. Remotely-armed ammunition according to claim 1 wherein the primer load comprises a barrier member located at one end of the primer load, wherein the circuitry is positioned adjacent to the barrier member, and a primer is electrically connected to the circuitry, and the primer is located at an end of the primer load opposite the barrier member.

3. Remotely-armed ammunition according to claim 2 wherein the circuitry comprises an energy power source, an arming circuit for receiving an arming signal, and a firing circuit for igniting the primer.

4. Remotely-armed ammunition according to claim 3 wherein the energy power source is a battery.

5. Remotely-armed ammunition according to claim 3 wherein the energy power source is a capacitor.

6. Remotely-armed ammunition according to claim 3 wherein said arming circuit includes a fail-safe circuit for disabling said cartridge to prevent the firing thereof upon an attempt to fire the ammunition in the absence of the arming signal.

7. Remotely-armed ammunition according to claim 1 wherein the receiver receives electromagnetic signals at a frequency which must match the frequency of the electromagnetic signals transmitted by the transmitter to constitute the arming signal.

8. A primer load comprising:

a barrier member located at one end of the primer load;

circuitry positioned adjacent to the barrier member, the circuitry including a receiver which is activated only upon receiving an electromagnetic signal at a predetermined frequency from a transmitter separate from the primer and a firearm used to fire the primer;

and an electrically-ignitable primer electrically connected to the circuitry, the primer being located at an end of the primer load opposite the barrier member, the primer load including circuitry which selectively permits igniting a primer.

9. The primer load having the circuitry according to claim 8 comprising an energy power source, an arming circuit for receiving an arming signal, and a firing circuit for igniting the primer.

10. The primer load having the circuitry according to claim 9 wherein the energy power source is a battery.

11. The primer load having the circuitry according to claim 9 wherein the energy power source is a capacitor.

12. A fail-safe ammunition system comprising a transmitter; and a cartridge including:

a case having, at one end, a pocket into which a primer load is inserted, propellent within the case, and, at an end opposite the pocket, an open end into which a projectile is inserted;

a primer load including circuitry which selectively permits igniting a primer upon receiving a transmitted signal from the transmitter, the primer load being inserted into the pocket of the cartridge, the transmitter being separate from the cartridge and a firearm used to fire the cartridge.

13. A fail-safe ammunition system according to claim 12 wherein the transmitter transmits an electromagnetic signal on a predetermined frequency and the circuitry which selectively permits igniting the primer contains a receiver which receives only on the predetermined frequency.

* * * * *